United States Patent [19]

Hooper

[11] Patent Number: 4,537,396

[45] Date of Patent: Aug. 27, 1985

[54] ENERGY ABSORBER FOR EXERCISING MACHINES

[75] Inventor: Lindsay A. Hooper, Victoria, Australia

[73] Assignee: Repco Ltd., Melbourne, Australia

[21] Appl. No.: 507,145

[22] Filed: Jun. 23, 1983

[30] Foreign Application Priority Data

Jun. 24, 1982 [AU] Australia ..... PF4580

[51] Int. Cl.[3] ..... A63B 21/00; A63B 31/00; A63B 69/06

[52] U.S. Cl. ..... 272/130; 272/72; 272/73; 272/71; 272/132

[58] Field of Search ..... 272/116, 117, 131, 128, 272/130, 132, 135, 71, 72, 73, DIG. 4, DIG. 5, DIG. 6; 128/24 R

[56] References Cited

U.S. PATENT DOCUMENTS

| | | | |
|---|---|---|---|
| 770,994 | 9/1904 | White | 272/128 |
| 1,869,673 | 8/1932 | Duff | 272/128 |
| 3,704,886 | 12/1972 | Kay | 272/132 X |
| 4,047,715 | 9/1977 | Gjessing | 272/132 |
| 4,082,264 | 4/1978 | Santos | 272/130 X |
| 4,082,267 | 4/1978 | Flavell | 272/71 |
| 4,470,597 | 9/1984 | McFee | 272/128 |

FOREIGN PATENT DOCUMENTS

| | | | |
|---|---|---|---|
| 2016652 | 12/1982 | Fed. Rep. of Germany | 272/71 |
| 0782818 | 11/1980 | U.S.S.R. | 272/71 |

*Primary Examiner*—Richard J. Apley
*Assistant Examiner*—Kathleen D'Arrigo
*Attorney, Agent, or Firm*—Stevens, Davis, Miller & Mosher

[57] ABSTRACT

An energy absorber module usable with a variety of exercising machines and including an air displacement fan which is driven by a pair of pull cords through a one way clutch. The fan is contained within a housing secured to the frame of the module and the pull cords extend through guide holes in a face board also secured to that frame. The pull cords are wound upon drums which drive the fan when rotated in one direction, but which are freely rotatable in the reverse direction because of the clutch. A return cord is also wound upon each drum, but in the reverse direction to the pull cords, and is connected to a return spring for causing reverse rotation of the drums. A signal proportional to the rotational speed of the fan is processed through an electronic circuit to provide appropriate work information on a meter or recorder. The pull cords can be selectively engagable with other guide means according to the type of machine with which the module is to be used.

14 Claims, 15 Drawing Figures

ENERGY ABSORBER FOR EXERCISING MACHINES

This invention relates to exercising machines and in particular to an energy absorber for such machines.

The energy absorbance function of exercising machines is attended to in a variety of ways and involves some form of resistance which is preferably variable to enable variation of the work output of the user. Traditional systems involve the use of weights to provide the necessary resistance and the degree of resistance is varied by changing the weights. Such systems are clumsy and do not lend themselves to work measurement so there is no accurate record of the work done by the user. More sophisticated systems involve electro-magnetic means for generating the variable resistance and although such systems lend themselves to work measurement they are somewhat complicated and expensive.

A much simpler system involves fluid displacement and such a system can be easily adapted to any of a variety of exercising machines. Also, such a system lends itself to convenient and accurate work measurement functions.

It is an object of the present invention to provide an energy absorber for exercising machines which involves use of fluid displacement and which can be used for a variety of exercise functions. It is a further object of the invention to provide such an energy absorber having a relatively simple and accurate work measurement function.

According to one aspect of the present invention, there is provided an energy absorber module for an exercising machine including, a frame, an air displacement fan rotatably mounted on said frame, drive means rotatably mounted on said frame, clutch means operable to transmit drive from said drive means to said fan to cause rotation thereof when said drive means is rotating in one direction only relative to said frame, at least one pull cord connected to said drive means and being operable to cause rotation of said drive means in said one direction, and return means operative to rotate said drive means in the direction opposite to said one direction and thereby return said drive means towards a rest position when tension in said pull cord is released.

According to another aspect of the invention, there is provided an energy absorber for ergometric apparatus including a rotor operable to cause displacement of air, shroud means at least partially enclosing said rotor and being arranged to modify the movement of said displaced air, inlet means whereby air is induced into said absorber through operation of said rotor, outlet means through which said displaced air is exhausted from said absorber, and an air passage formed between said rotor and said shroud means and communicating with said outlet means, said air passage being arranged to encourage flow of said displaced air through said outlet means.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

An energy absorber according to the invention includes a fan or rotor which is operable to displace air, drive means for causing rotation of the fan in one direction and return means for rotating the fan drive system in the opposite direction towards a rest position. The fan is preferably contained within a housing and that housing may form part of a module which is adaptable to a variety of exercise functions. One particular form of module will be hereinafter described, but that is not the only form which may incorporate the invention.

Figure 4:
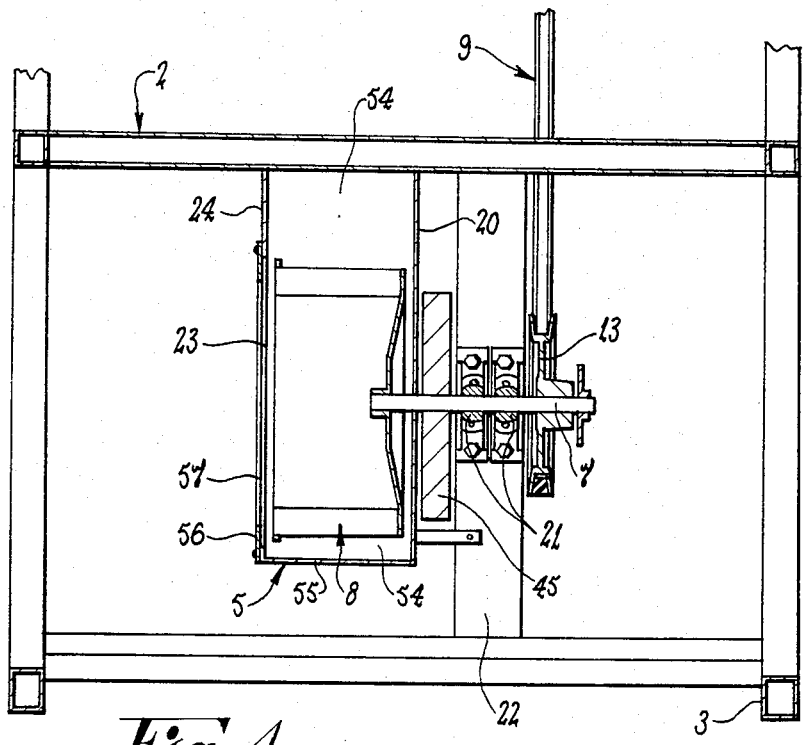
FIG. 4 is a cross sectional view taken along line IV—IV of FIG. 2.
Figure 5:
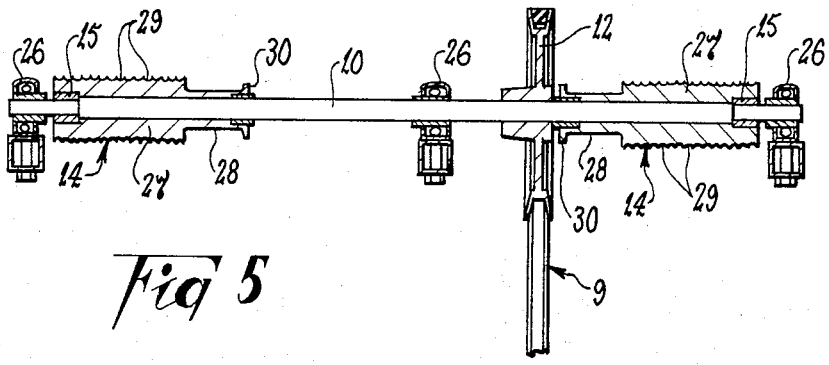
FIG. 5 is a cross sectional view taken along line V—V of FIG. 2.

The example module 1 shown in FIGS. 1 to 5 includes a frame 2 having a base 3 and a front upright section 4. The fan housing 5 is supported on that frame 2 and has an outlet 6 adjacent to the front section 4 of the frame 2 for a reason hereinafter made clear. A spindle 7 rotatably mounted on the frame 2 carries the fan 8 and, as shown, preferably projects to one side of the housing 5 for connection to the drive means 9. In the form shown, that drive means 9 includes a drive shaft 10 connected to the spindle 7 through a belt 11 and pulleys 12 and 13, but other appropriate means could be used for that purpose. As best seen in FIG. 5, two drums 14 are rotatably mounted on respective opposite end portions of the shaft 10 and each is drivably connected to the shaft 10 through a respective one way clutch 15. Each clutch 15, which may be sprag or roller-type clutch of known construction, is arranged so that the respective drum 14 can rotate in one direction relative to the shaft 10, but not in the other, and those directions will be hereinafter referred to as the free and drive directions respectively. A respective pull cord 16 is connected to each drum 14 and also forms part of the drive means.

The clutches 15 need not be arranged as shown, but could be located at any other suitable position within the drive system. Indeed, a single clutch could be used if desired, and that may be carried by either the shaft 10 or the spindle 7.

Figure 1:
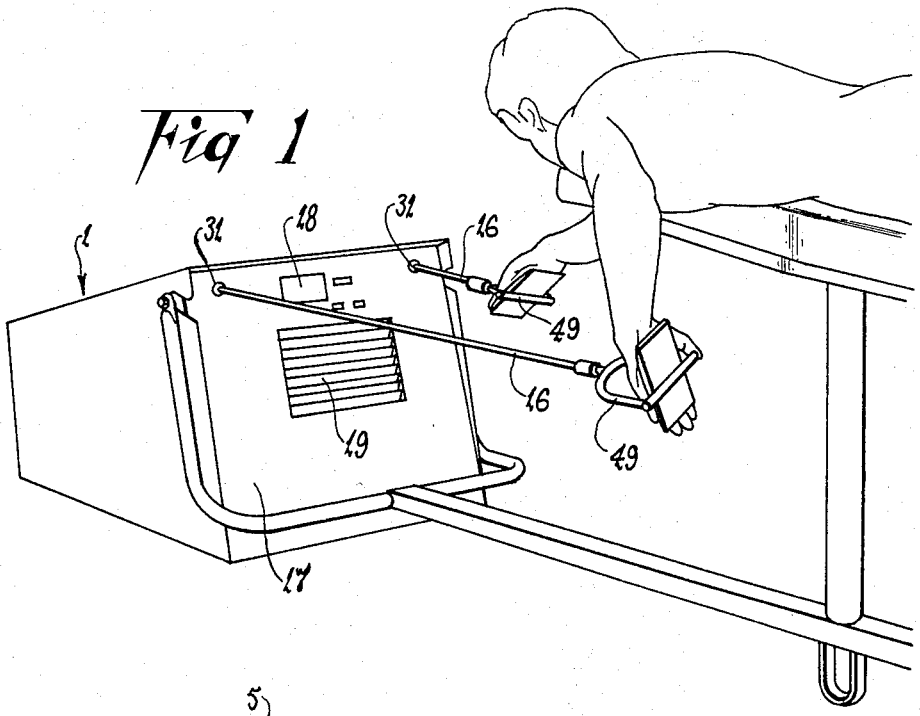
FIG. 1 is a semi-diagrammatic perspective view of part of one form of exercising machine incorporating an embodiment of the invention.

It is preferred to provide a face board 17 on the upright section 4 of the frame 2 and that may serve several functions in addition to hiding mechanical components of the module from view. For example, the face board 17 may provide a support for accessories or devices such as a work output meter 18 or the like (FIG. 1). Also, an opening 19 in the face board 17 is preferably adjacent the outlet 6 of the fan housing 5 and therefore provides a draft outlet which can be arranged to direct a stream of air over the user of the module 1.

The fan housing 5 is preferably of volute or scroll type as shown having its outlet 6 adjacent the face board opening 19 as discussed above. The fan spindle 7 extends transversely through a side wall 20 of the housing 5 to be supported in bearings 21 located externally of the housing 5 and carried by an appropriate part 22, of the frame 2. An inlet opening 23 for the housing 5 is provided through the opposite side wall 24 of the housing and is preferably substantially coaxial with the fan 8.

Figure 2:
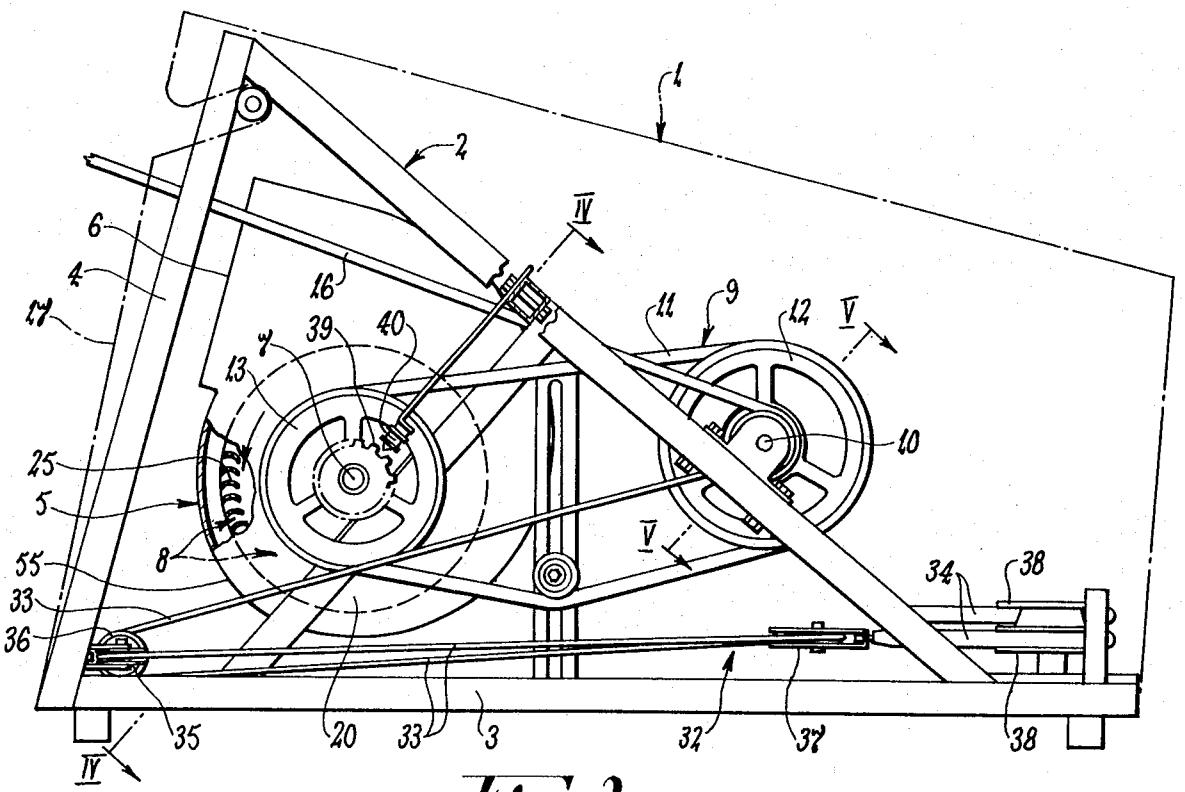
FIG. 2 is a side elevation view of the energy absorber module shown in FIG. 1, but with the cover removed.
Figure 3:
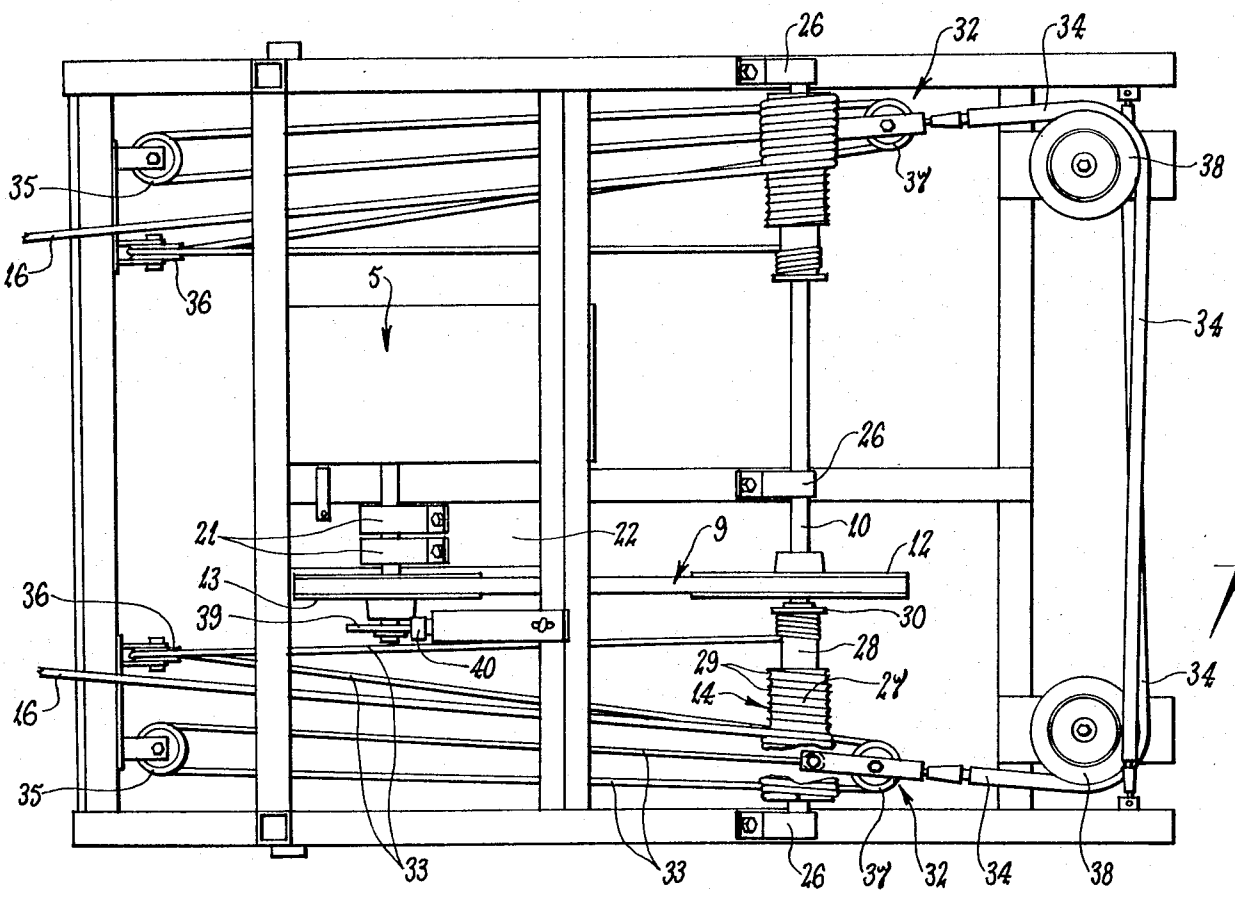
FIG. 3 is a plan view of the module shown in FIG. 2.

Any appropriate form of centrifugal fan 8 may be adopted. It is preferred however, that the fan 8 is elongate in the axial direction and has blades 25 which are curved so that their concave faces are the leading faces in the normal direction of rotation of the fan 8 (FIG. 2).

The drive shaft 10 may be located rearward of the fan housing 5 as shown and is supported by bearings 26 (FIG. 3) carried by the frame 2. Preferably, both the fan housing 5 and drive shaft 10 are spaced upwardly from the frame base 3. In the arrangement shown, the drive shaft pulley 12 is of the same size as the clutch pulley 13, but different pulley sizes may be adopted to give a suitable drive ratio between the shaft 10 and fan.8.

In the drive arrangement described and shown, drive is transmitted to the fan 8 only when either or both of the drums 14 is rotated in the drive direction. Under those circumstances, each clutch 15 functions to transmit drive from the respective drum 14 to the shaft 10 which in turn transmits drive to the fan spindle 7 through the belt 11 and pulleys 12 and 13. If the drum 14 is rotated in the reverse or free direction, the clutch 15 automatically releases its influence on the shaft 10 so that the drum 14 will turn freely relative to that shaft 10.

Each drum 14 is preferably of stepped construction as shown so as to have two sections 27 and 28 of different diameter. A helical groove 29 is preferably formed in each large diameter section 27 and that groove 29 is dimensioned to suit the pull cord 16 which is wound upon that section of the drum 14. Any suitable means may be adopted for securing one end of each cord 16 to its respective drum 14. An end flange 30 is provided at the outer end of the smaller section 28 for a reason hereinafter made clear.

In the rest position of the drive shaft 10, a portion of each cord 16 is wound upon the respective drum section 27 in a direction such that when the cord 16 is pulled to unwind from the drum 14, the shaft 10 is caused to rotate in the drive direction. Each cord 16 may extend, as shown, from the drive shaft 10 through holes 31 (FIG. 1) provided in the face board 17 so as to be accessible to the user at the front of that board 17. Any suitable means may be adopted to limit movement of the cord 16 back through the face board 17 and in that way establish the rest position of the drive shaft 10.

The return means 32 of the construction shown, includes a cord 33 which is wound upon a respective drum section 28 in the reverse direction to the pull cord 16, and spring means 34 which draws the return cord 33 in a direction to unwind it from the drum 14. That is, there are two return cords 33 and associated springs 34 secured to respective drums 14, and each spring 34 may constitute a length of elastic shock-cord. In the arrangement shown, each return cord 33 is turned about a series of pulleys 35, 36 and 37 in a manner such as to decrease the purchase (mechanical advantage) of the return spring 34. That is, the system reduces the necessary degree of movement of the return spring 34 between the fully wound and fully withdrawn conditions of the pull cord 16.

It is preferred, as shown, that the pulleys 35 and 36 are secured to the frame 2, whereas each pulley 37 is movable relative to the frame 2. Each return spring 34 has its opposite ends secured to a respective pulley 37 and the frame 2 respectively, and is turned about another pulley 38 which is also secured to the frame 2. Opposite end portions of each return cord 33 are secured to the drum 14 and a pulley 37 respectively, and in the rest position of the shaft 10 an end portion of the cord 33 is wound upon the drum section 28. The end flange 30 serves to retain that cord end portion on the drum 14.

With the foregoing arrangement, when either or each pull cord 16 is drawn outwardly to unwind from the respective drum 14, the resulting rotation of the drive shaft 10 causes the return cords 33 to be wound upon their respective drum sections 28. Such winding of the return cords 33 occurs against the influence of the return springs 34 so those springs are progressively tensioned. That is, the pulleys 37 must move away from the pulleys 38 in order to allow the cords 33 to be wound upon the drums 14, and that movement necessary tensions the springs 34. When the withdrawing force is removed from the pull cords 16, the return springs 34 functions to pull the return cords and thereby rotate the drums 14 in the reverse or free direction such that the pull cords 16 are progressively wound back upon the drum sections 27. During that reverse rotation, the clutches 15 release the drums 14 from driving influence on the shaft 10 as previously described.

A fan absorber of the kind described can be easily calibrated for the purposes of obtaining an accurate read-out of work done. The fan 8 follows the third power law of fluid dynamics under which the energy absorbed increases with the cube of the increase in speed. Consequently, a single speed measurement can be adapted to provide the necessary read-out.

Figure 6:
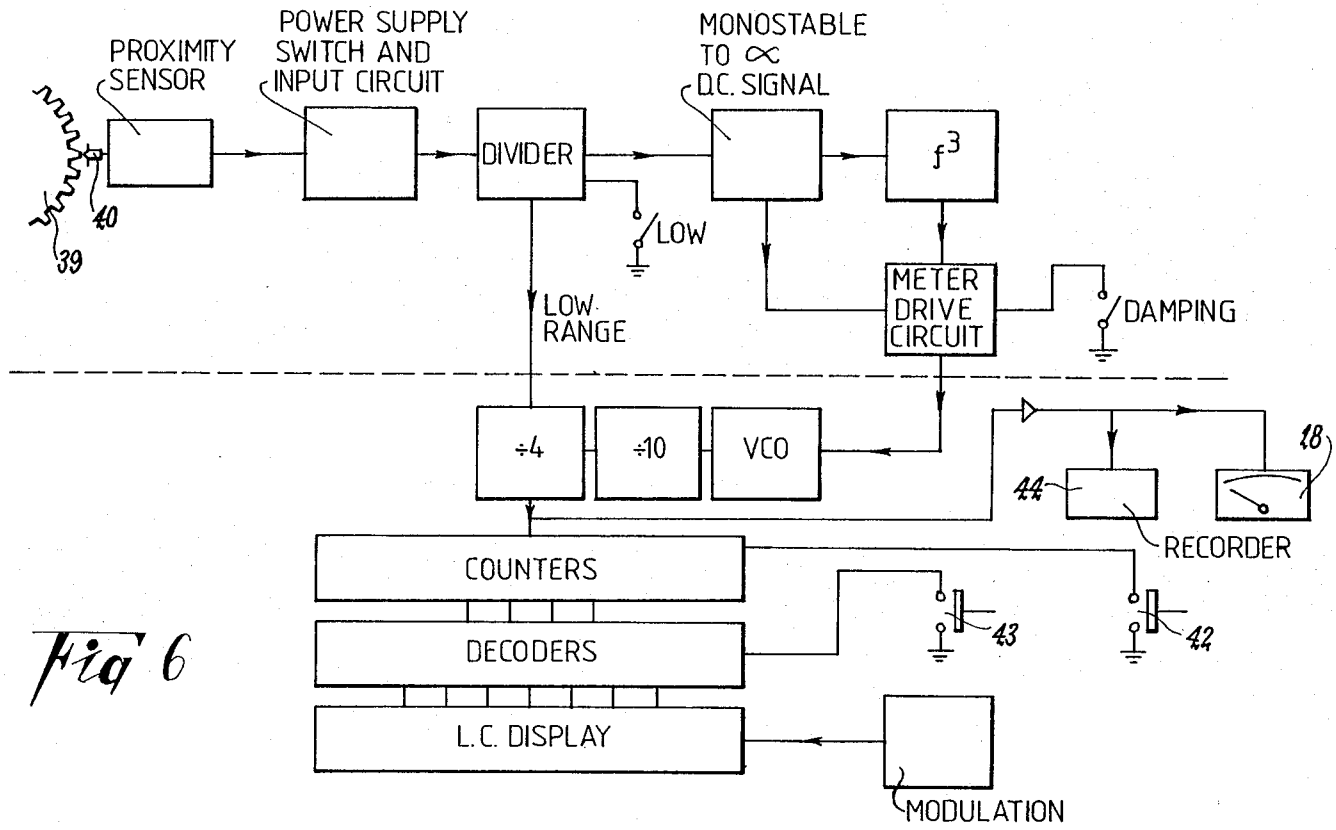
FIG. 6 is a block diagram of one form of meter circuit as used with the module of FIGS. 2 to 5.

In the example arrangement shown, the speed measurement is obtained by way of a toothed wheel 39 secured to the fan spindle 7 and a magnetic sensor 40 which responds to rotation of that wheel to produce a pulsed signal, the frequency of which varies with variation in the speed of the fan spindle 7. That signal may be fed to an electronic processing circuit —e.g., as shown in FIG. 6 —which produces an appropriate display on an analogue meter 18 which may, for example, display work rate in watts and accrued work in kilojoules. As previously stated, the meter 18 can be mounted on the face board 17 of the module 1 together with other equipment as required. The aforementioned circuit may include a compensation for the work needed to overcome frictional losses in the drive system and the resistance of the return springs.

The display 41 starts automatically as the unit is operated and the accrued work remains displayed until reset by means of an appropriate switch 42. Another switch 43 enables the display to be held for notation with the kilojoules read-out continuing to be accumulated by a processor included in the electronic circuit. The linear signal of work rates supplied to the analogue meter 18 can also be used as an input to a pen recorder 44 so that all work done on any exerciser to which the absorber is applied can be recorded graphically in terms of the number and power of strokes or repetitions and the duration of the exercise.

Any appropriate circuit may be used for the purpose discussed above, and an example only is shown in FIG. 6. Variations of that circuit are obviously available.

Figure 7:
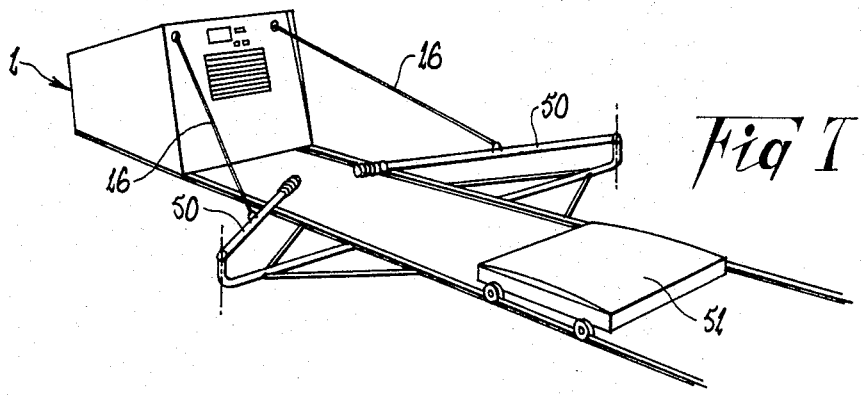
FIG. 7 is a semi-diagrammatic perspective view of a rowing machine incorporating a module according to FIGS. 2 to 5.
Figure 8:
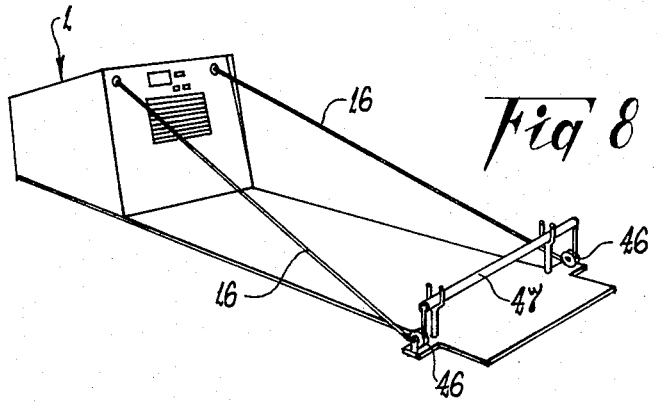
FIG. 8 is a semi-diagrammatic perspective view of a weight lifting machine incorporating a module as shown in FIGS. 2 to 5.
Figure 9:
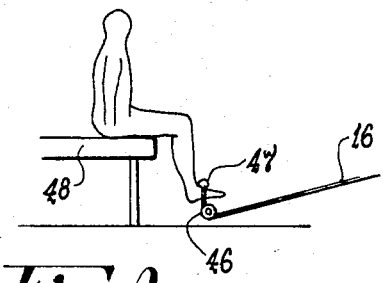
FIGS. 9 and 10 show adaptions of the FIG. 8 machine for leg exercising purposes.
Figure 10:
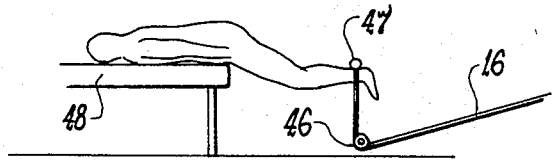
Figure 11:
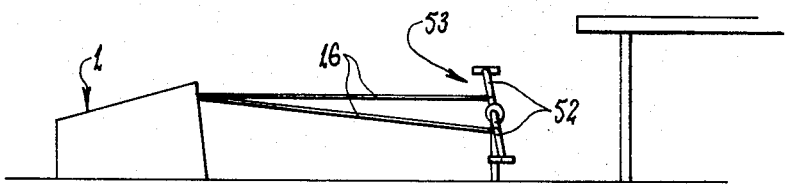
FIG. 11 is a side elevational view of a cycling machine incorporating a module as shown in FIGS. 2 to 5.
Figure 12:
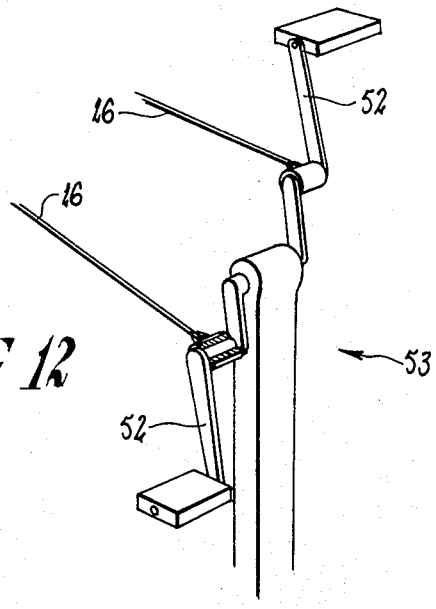
FIG. 12 is an enlarged perspective view of part of the machine shown in FIG. 11.

The module is clearly adaptable for use in a wide variaty of exercise machines such as machines simulating and providing work measurement for swimming, kayaking, and rowing. An example swimming exerciser is shown in FIG. 1 and an example rowing exerciser is shown in FIG. 7. The module may be also used for standard weight lifting as shown in FIG. 8 or leg exercising functions as shown in FIGS. 9 and 10. FIGS. 11 and 12 show the module adapted to a cycle exerciser. In all instances accurate work measurement is available in the manner described.

In some cases, the module may require adjustment or variation to maximise the simulation effect. For example, a flywheel 45 (FIG. 4) of appropriate mass may be attached to the fan spindle 7 to provide a suitable "feel" in the resistance to withdrawal of the pull cords 16. Another possible form of adjustment is to vary the rate of absorption of the fan unit and/or vary the drive ratio between the drive shaft 10 and fan spindle 7.

If the module is to be used in a weight lifting machine as shown in FIG. 8, the drive ratio between the drive shaft 10 and spindle 7 may be in the region of 3.5 to 1 and a flywheel 45 may be provided on the spindle 7 to provide a relatively heavy feel. The pull cords 16 preferably extend beneath respective guide pulleys 46 located forwardly of the face board 17 and secured to the base or floor, and the terminal end of each cord 16 is secured to the respective end portion of a lifting bar 47. Lifting of the bar 47 causes the pull cords 16 to be drawn through the face board 17 so that the fan 8 is rotated in the manner previously described.

The weight lifting machine can be converted for leg exercises simply by the addition of a bench 48 to support the user in a seated or prone position (see FIGS. 9 and 10).

When the module is used in a swimming machine (FIG. 1), a bench 48 is also provided so that the user can lie in a prone position and appropriate hand grips 49 are provided at the terminal end of each pull cord 16. The guide pulleys 46 as used in the weight lifting machine would normally be omitted for the swimming machine. Rowing and kayaking machines (FIG. 7) involve the use of appropriate oar or paddle devices 50 to which the or each pull cord 16 is connected, and a sliding seat 51 for supporting the user. In the cycle exerciser of FIGS. 11 and 12, a bench 48 is again used, although the user could stand if desired, and each pull cord 16 is connected to a respective crank arm 52 of a pedal assembly 53.

The energy absorber (fan assembly) as used in the module previously described, has several advantages including the ability to allow evaluation of work done to be carried out simply and with substantial accuracy. Other exercisers have previously used similar "cube-law" absorbers and one such prior exerciser is described in Australian Pat. No. 462,920. The machine according to U.S. Pat. No. 462,920 is a cycle ergometer, in which the construction of the air absorber was dictated by cycle industry practice and consists of air paddles mounted on individual spokes of a cycle wheel. That absorber is cumbersome and not readily suitable for other exercise machine applications.

Other simple paddle-type air absorbers are disclosed by U.S. Pat. Nos. 584,989 and 984,050. In those constructions the energy absorption rate is varied by adjusting the paddle blades to have greater or lesser resistance to movement through air. That form of adjustment however, is relatively complex and furthermore enables a relatively small variation of absorption rate. Also, insufficient benefit, for the purposes of the present invention, results from using impellers of different construction —e.g., axial or centrifugal —in open air as has been the practice to date.

A feature of the absorber unit particularly shown in the accompanying drawings is that it involves modification of the flow of displaced air to achieve the desired absorption rate. That technique enables a far greater range of absorption rates to be achieved than is possible with prior air absorbers as previously used with exercise apparatus. By way of example, from minimum to maximum modification of the flow of displaced air (which is equivalent to minimum and maximum absorption respectively) a torque ratio of greater than 4:1 may result for any given speed of a particular impeller.

The absorber shown utilizes a fan or rotor 8 of the centrifugal type in which air is induced to enter the body of the fan through one or both ends and to then pass out of the fan through the spaces between the blades 25. It is a feature of the construction shown that the fan housing serves to modify the flow of air displaced by the fan 8 and to thereby influence the absorption potential of the unit. For example, the absorption potential will usually be decreased if the flow of displaced air is impeded. Such a flow modifying housing 5 can be of relatively simple form and may be interchangable to enable variation of the absorption potential, or it may be adjustable in a manner such as to permit such variation.

Figure 13:
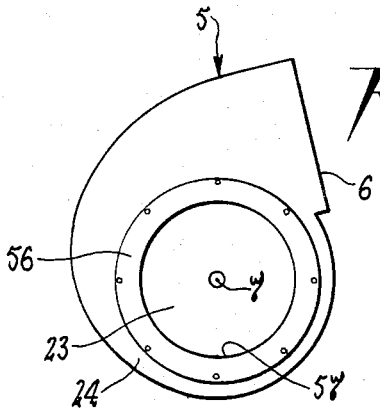
FIG. 13 is a view taken along line XIII—XIII of FIG. 4.
Figure 15:
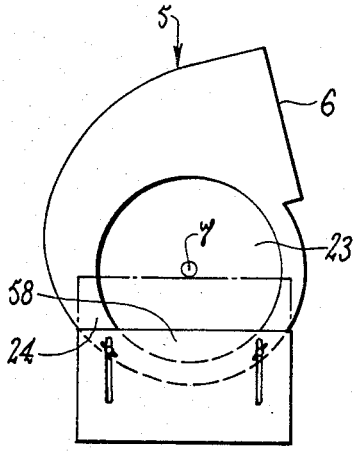
FIG. 15 is a view similar to FIG. 13 but showing a different method of varying the housing opening.
Figure 14:
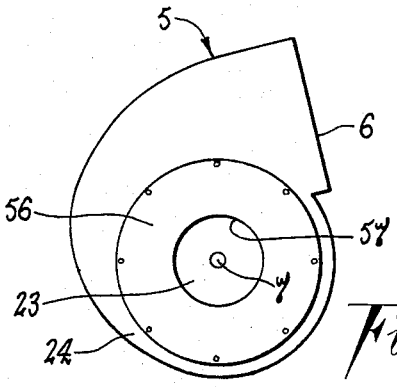
FIG. 14 is a view similar to FIG. 13 but showing a variation to the housing opening.

The size and form of the air passage 54 provided between the fan 8 and surrounding wall 55 of the housing 5, is one factor which determines the nature of the air flow modification and consequently the torque at a given speed. In the construction particularly shown, entrance of air to the fan 8 is restricted to the inlet opening 23 and the size of that opening is a controlling factor in that it can be selected to achieve a particular flow of air displaced by the fan 8 and thereby determine the absorption torque for any given speed of the fan 8. For example, annular plates 56 having openings 57 of various sizes may be selectively attached to the housing wall 24 as shown in FIGS. 4, 13 and 14, so as to vary the effective size of the opening 23. Alternatively, as shown in FIG. 14, an adjustably mounted plate 58 can be used to vary the effective size of the opening 23. Variation of the size of the opening 23 is only one of several possible methods for selecting a particular absorption torque (within the available range) for any given speed of the fan 8. Another possibility is to provide baffles within the flow passage 54.

It will be appreciated that the foregoing construction provides a relatively simple yet effective absorber for exercise or ergometric apparatus. A particular advantage is that variations of torque load versus speed in no way interfere with the cube law of the absorber, hence the ability to arrive at an energy absorption value from the rotational speed of the absorber by a simple cube law calibration is maintained. A further advantage is obtained in that, given the variations of absorption from machine to machine due to production tolerances, these variations can be compensated for and accurate calibration achieved by very simple means of adjustment of air absorber flow.

It will be further appreciated from the foregoing description that the invention provides an effective and versatile energy absorber for use with a wide variety of exercise machines. The basic module can be varied in several ways to suit particular circumstances and may be arranged to operate with a single machine or it may serve a plurality of different machines as required.

Variations alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. An energy absorber module for an exercising machine, including:

a frame;

a face board secured to said frame;

a fan housing secured to said frame;

an energy absorber in the form of an air displacement fan rotatably mounted within said housing;

a pair of drive drums rotatably mounted on said frame in axially spaced relationship, wherein each said drum is stepped to form two sections of different diameter;

a drive connection between said drums and said fan, at least one clutch in said drive connection and being operable to transmit drive from said drums to said fan only when said drums are rotating in one direction relative to said frame;

a pair of pull cords each extending beyond said face board and each connected to a respective first diameter section of each said drum and having a portion wound thereupon in a rest position of the drum so that tension applied to each said cord, to cause unwinding movement thereof, causes rotation of said drum in said one direction;

a pair of return cords, each of which is attached to a respective second diameter section of each of said drums and arranged to be wound thereupon during rotation of the drums in said one direction; and spring means comprising two lengths of elastic shock-cord, each of which is attached to said frame and to a respective said return cord and being operable upon release of tension in said pull cords to unwind said return means from said drums to thereby cause rotation of said drums in the direction opposite to said one direction.

2. An exercising machine, including the module of claim 1, and a hand engagable member secured to an end of each said pull cord and located on the side of said face board remote from said fan.

3. An exercising machine, including a module according to claim 1, and a weight lifting bar secured to an end portion of each said pull cord, and each said pull cord engages guide means at a location between said end portion and said face board.

4. An exercising machine, including a module according to claim 1, and a foot pedal device located on the side of said face board remote from said fan, and in an end portion of each said cord is connected to said foot pedal device.

5. An energy absorber module for an exercising machine, including:

a frame;

an energy absorber in the form of an air displacement fan rotatably mounted on said frame;

a clutch means;

a drive means, including a drive shaft, a drum and at least one pull cord; and a return means, including a spring means, a plurality of pulleys, said drum and a return cord, wherein said drive shaft is rotatably mounted on said frame with its axis substantially parallel to the rotational axis of said fan, said drum is rotatably mounted on said shaft and said pull cord is connected to said drum and is wound thereupon when said drum is in a rest position, and said pull cord is operable to cause rotation of said drum in one direction only relative to said frame, and said clutch means is operable to only transmit drive from said drum to said shaft when said drum is rotating in said one direction, to cause said fan to rotate, and wherein said return cord is also connected to said drum so that an end portion thereof is wound upon the drum as the drum rotates in said one direction, and wherein said return cord is turned about said plurality of pulleys to increase the purchase of said return means, wherein one of said pulleys is arranged for movement relative to said frame; and a spring means connected to said frame is also connected to said movable pulley and said return cord, whereby said spring means is operable to unwind the return cord from said drum and said return means is operable to rotate said drive means in the direction opposite said one direction, and thereby return said drive means towards a rest position when tension in said pull cord is released.

6. A module according to claim 5, wherein a flywheel is connected to said fan for rotation therewith.

7. A module according to claim 5, including a sensor which is responsive to rotation of said fan to produce a signal which varies with variation of the rotational speed of said fan and a meter which is responsive to said signal to display the rate of work being done during rotation of said fan.

8. A module according to claim 7, wherein said meter includes an electronic circuit through which said signal is processed, and said circuit is operable to cause said meter to give a read-out of both work rates and accrued work done.

9. A module according to claim 8, wherein said circuit includes switch means operable to cause cancellation of the accrued work display and further switch means operable to hold the meter displays for notation purposes, and said circuit continues to process and store accrued work information while said further switch means remains operated.

10. A module according to claim 7, including a recorder which is responsive to said signal to provide graphic representation of work done during rotation of said fan, including the number of strokes of said pull cord and the duration of said fan rotation.

11. A module acccording to claim 8, wherein said circuit automatically compensates for the work needed to overcome frictional loss and resistance of said return means.

12. An energy absorber for ergometric apparatus including a rotor operable to cause displacement of air, said rotor comprising a cylindrical impeller having a plurality of blades arranged in circumferentially spaced relationship about the periphery thereof, shroud means at least partially enclosing said rotor and being arranged to modify the movement of said displaced air, inlet means whereby air is induced into said absorber through operation of said rotor, outlet means through which said displaced air is exhausted from said absorber, said impeller having a hollow interior into which air is induced through said inlet means and said blades are operable to cause centrifugal displacement of air in response to rotation of said impeller, an air passage formed between the cylindrical outer periphery of said impeller and a wall of said shroud means which extends around said outer periphery, said air passage communicating with said outlet means and being arranged to encourage flow of said displaced air through said outlet means, said shroud means wall is involute in shape and substantially surrounds said impeller, said air passage is defined by a space extending around said impeller and which progressively increases from a minimum to a maximum circumferentially of said impeller, and said outlet means is defined by an opening in said shroud at a location substantially coincident with where said space is at the maximum.

13. An energy absorber according to claim 12, including means for selectively varying the energy absorption potential of said rotor.

14. An energy absorber according to claim 12, wherein said inlet means includes an opening through said shroud, and means is provided to enable variation of the effective size of said opening and thereby vary the energy absorption potential of said rotor.

* * * * *